US006598690B2

(12) United States Patent
Peterson

(10) Patent No.: US 6,598,690 B2
(45) Date of Patent: Jul. 29, 2003

(54) DUAL DYNAMIC ROTARY SEAL

(75) Inventor: Steven W. Peterson, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 13 days.

(21) Appl. No.: 09/922,228

(22) Filed: Aug. 3, 2001

(65) Prior Publication Data

US 2003/0024743 A1 Feb. 6, 2003

(51) Int. Cl.[7] ..... E21B 9/08; F16J 15/34

(52) U.S. Cl. ..... 175/371; 175/374; 277/336

(58) Field of Search ..... 175/371, 372, 175/337, 227, 369, 374; 277/336, 380, 339, 641, 642, 928, 910

(56) References Cited

U.S. PATENT DOCUMENTS

| | | | | |
|---|---|---|---|---|
| 3,075,781 A | | 1/1963 | Atkinson et al. | 277/83 |
| 3,765,495 A | | 10/1973 | Murdoch et al. | 175/371 |
| 4,277,109 A | * | 7/1981 | Crow | 308/8.2 |
| 4,428,588 A | * | 1/1984 | Oelke | 277/83 |
| 4,466,622 A | | 8/1984 | Deane et al. | 277/92 |
| 5,362,073 A | | 11/1994 | Upton et al. | 277/92 |
| 5,842,700 A | | 12/1998 | Fang et al. | 277/336 |
| 5,842,701 A | | 12/1998 | Cawthorne et al. | 277/336 |
| 6,109,376 A | * | 8/2000 | Pearce | 175/371 |
| 6,170,830 B1 | | 1/2001 | Cawthorne et al. | 277/336 |
| 6,179,296 B1 | | 1/2001 | Cawthorne et al. | 277/336 |
| 6,427,790 B1 | * | 8/2002 | Burr | 175/371 |

FOREIGN PATENT DOCUMENTS

| | | | |
|---|---|---|---|
| GB | 1084147 | 9/1967 | |
| GB | 2 335 936 A | 10/1999 | |
| GB | 2 355 743 A | 5/2001 | E21B/10/22 |

OTHER PUBLICATIONS

Great Britain search report dated Nov. 14, 2002, 2 pages.

* cited by examiner

*Primary Examiner*—Frank Tsay
(74) *Attorney, Agent, or Firm*—Rosenthal & Osha L.L.P.

(57) ABSTRACT

The invention is a roller cone drill bit including a seal adapted to seal between the bit body and a roller cone on the drill bit. The seal includes a seal body formed from a material that is adapted to energize the seal after compression of the seal. A first dynamic seal surface formed on the seal body and is adapted to seal against the bit body. A second dynamic seal surface is formed the seal body and is adapted to seal against the roller cone. The first and second dynamic seal surfaces are formed from a material adapted to withstand relative motion between the first dynamic seal surface and the bit body and between the second dynamic seal surface and the roller cone.

94 Claims, 6 Drawing Sheets

DUAL DYNAMIC ROTARY SEAL

BACKGROUND OF INVENTION

1. Field of the Invention

The invention relates generally to seals used with roller cone drill bits. More specifically, the invention relates to rotary seals that include more than one dynamic sealing surface for maintaining lubrication in roller cone drill bits.

2. Background Art

Drill bits are commonly used in, for example, the oil and gas exploration industry for drilling wells in earth formations. One type of drill bit commonly used in the industry is the roller cone drill bit. Roller cone drill bits generally comprise a bit body connected to a drill string or bottom hole assembly (BHA). Roller cone drill bits typically include a plurality of roller cones rotatably attached to the bit body. The roller cones are generally mounted on steel journals integral with the bit body at its lower end. The roller cones further comprise a plurality of cutting elements disposed on each of the plurality of roller cones. The cutting elements may comprise, for example, inserts (formed from, for example, polycrystalline diamond, boron nitride, and the like) and/or milled steel teeth that are coated with appropriate hardfacing materials.

When drilling an earth formation, the roller cone drill bit is rotated in a wellbore, and each roller cone contacts the bottom of the wellbore being drilled and subsequently rotates with respect to the drill bit body. Drilling generally continues until, for example, a bit change is required because of a change in formation type is encountered in the wellbore or because the drill bit is worn and/or damaged. High temperatures, high pressures, tough, abrasive formations, and other factors all contribute to drill bit wear and failure.

When a drill bit wears out or fails as the wellbore is being drilled, it is necessary to remove the BHA from the well so that the drill bit may be replaced. The amount of time required to make a bit replacement trip produces downtime in drilling operations. The amount of downtime may be significant, for example, when tripping in and out of relatively deep wells. Downtime can add to the cost of completing a well and is a particular problem in offshore operations where costs are significantly higher. It is therefore desirable to maximize the service life of a drill bit in order to avoid rig downtime.

One reason for the failure of a roller cone drill bit is the wear that occurs on the journal bearings that support the roller cones. The journal bearings may be friction-type or roller-type bearings, and the journal bearings are subjected to high loads, high pressures, high temperatures, and exposure to abrasive particles originating from the formation being drilled. The journal bearings are typically lubricated with grease adapted to withstand tough drilling environments, and such lubricants are an important element in the life of a drill bit.

Lubricants are retained by a journal bearing seal, which is typically an O-ring type seal. The seal is typically located in a seal groove formed on an interior surface of a roller cone. The seal generally includes a static seal surface adapted to form a static seal with the interior surface of the roller cone and a dynamic seal surface adapted to form a dynamic seal with the journal upon which the roller cone is rotatably mounted. The seal must endure a range of temperature and pressure conditions during the operation of the drill bit to prevent lubricants from escaping and/or contaminants from entering the journal bearing. Elastomer seals known in the art are conventionally formed from a single type of rubber or elastomeric material, and are generally formed having identically configured dynamic and static seal surfaces with a generally regular cross section.

The rubber or elastomeric material selected to form the seal for the journal bearings has particular hardness, modulus of elasticity, wear resistance, temperature stability, and coefficient of friction, among other properties. Additionally, the particular geometric configuration of the seal surfaces produces a selected amount of seal deflection that defines the degree of contact pressure or "squeeze" applied by the dynamic and static seal surfaces against respective journal bearing and roller cone surfaces.

The wear, temperature, and contact pressures encountered at the dynamic seal surface are different than those encountered at the static seal surface. Therefore, the type of seal material and seal geometry that is ultimately selected to form both seal surfaces represents a compromise between satisfying the operating conditions that occur at the different dynamic and static seal surfaces. Conventional seals formed from a single-type of material, having symmetric axial cross-sectional geometries, may have reduced wear resistance and temperature stability at the dynamic seal surface where wear and temperature conditions are generally more severe than at the static seal surface. Therefore, the service life of drill bits that contain such seals may be limited by the service life of the journal bearing seal.

There have been several attempts to produce tough, long-lasting journal bearing seals that satisfy the requirements of both dynamic and static sealing of roller cone journal bearings. For example, U.S. Pat. No. 3,765,495 discloses a drill bit seal that has a greater radial cross section than axial cross section by a ratio of at least 1.5:1. The seal, which may be referred to as a "high aspect ratio seal," has a symmetrical, generally rectangular axial cross section and is made from a single type of elastomer. The seal has identically configured dynamic and static surfaces, and is formed from a single type of elastomeric material, reflecting a compromise between meeting the different operating conditions at each seal surface.

U.S. Pat. No. 5,362,073 discloses a composite drill bit seal formed from two or more different materials selected to provide a desired degree of wear resistance at the dynamic seal surface, and to provide a desired degree of seal contact at the static seal surface. The seal has a dynamic seal surface on its internal diameter formed from a single type of elastomeric material, and has inner and outer seal surfaces that are each formed from a different material than the other. Further, the dynamic seal surface has a radius of curvature less than that of each static seal surface.

U.S. Pat. Nos. 6,170,830 and 6,179,276 disclose drill bit seals that have asymmetric cross sections and that are formed from different elastomeric materials. The seals are circular in shape and are adapted to form a dynamic seal with a bearing journal on an inner face of the seal and a static seal with a surface of a roller cone on an outer face of the seal.

Prior art seals are generally adapted to form dynamic seals on inner surfaces and static seals on outer surfaces thereof. For example, the OD seal surface of prior art seal designs are arranged to form a static seal with an internal surface of a seal gland (where the seal gland is formed on an internal surface of a roller cone). During operation, if, for example, an increase in the operating temperature causes a decrease in desirable properties of the seal elastomer, the ID seal surface may become static by sticking, and the OD seal surface then becomes dynamic. When rotation occurs at the OD seal surface, which is usually formed from a relatively soft elastomer and has a relatively poor wear resistance, the OD seal surface experiences severe wear and may fail after a short time.

It is desirable to produce a seal that is capable of forming dynamic seals on both inner and outer surfaces to compensate, for example, for "stick-slip" conditions where rotation relative to the drill bit body and/or the roller cone occurs adjacent the inner surface of the seal, the outer surface of the seal, or adjacent to both inner and outer surfaces of the seal simultaneously.

SUMMARY OF INVENTION

One aspect of the invention is a roller cone drill bit including a seal adapted to seal between the bit body and a roller cone rotatably mounted on the bit body. The seal comprises a seal body formed from a material adapted to energize the seal after compression thereof, a first dynamic seal surface formed on the seal body and adapted to seal against the bit body, and a second dynamic seal surface formed the seal body and adapted to seal against the roller cone. The first and second dynamic seal surfaces are formed from a material adapted to withstand relative motion between the first dynamic seal surface and the bit body and between the second dynamic seal surface and the roller cone.

Another aspect of the invention is a drill bit including a seal adapted to seal between the bit body and a roller cone rotatably mounted on the bit. The seal comprises a seal body formed from a material adapted to energize the seal after lateral compression thereof, and the seal body also comprises a recessed upper axial surface and a recessed lower axial surface. The recessed upper and lower axial surfaces of the seal body are adapted to axially expand in a selected manner after lateral compression of the seal. The seal comprises a first dynamic seal surface formed on an inner diameter of the seal body and adapted to seal against the bit body and a second dynamic seal surface formed on an external diameter of the seal body and adapted to seal against the roller cone. The first and second dynamic seal surfaces are formed from a material adapted to withstand relative motion between the first dynamic seal surface and the bit body and between the second dynamic seal surface and the roller cone.

Another aspect of the invention is a drill bit comprising a bit body, at least one roller cone rotatably attached to the bit body, and a seal disposed between a first sealing surface located on the bit body and a second sealing surface located on the at least one roller cone. The seal further comprises a seal body formed from a material adapted to energize the seal after lateral compression thereof, a first dynamic seal surface disposed on an internal diameter of the seal body and adapted to seal against the first sealing surface, and a second dynamic seal surface disposed on an external diameter of the seal body and adapted to seal against the second sealing surface. The first and second dynamic seal surfaces formed from a material adapted to withstand relative motion between the first dynamic seal surface and the first sealing surface and between the second dynamic seal surface and the second sealing surface.

Other aspects and advantages of the invention will be apparent from the following description and the appended claims.

DETAILED DESCRIPTION

Figure 1:
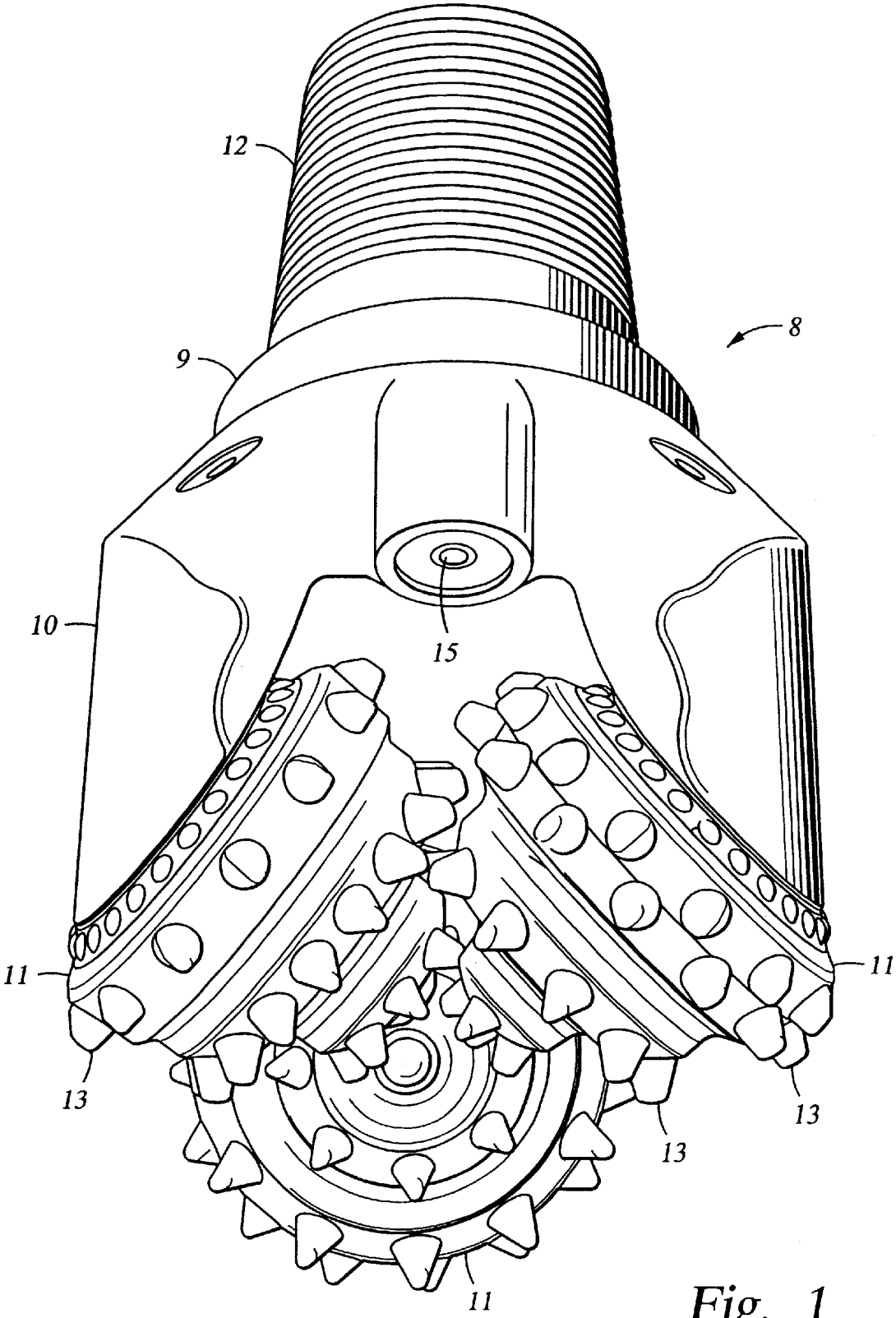
FIG. 1 shows a perspective view of a roller cone drill bit.

FIG. 1 shows a drill bit 8 comprising a bit body 9 and three roller cones 11 rotatably attached to the bit body 9. A means for attaching the drill bit 8 to a bottom hole assembly (BHA) (not shown), such as a threaded connection 12, is positioned at an upper end of the bit body 9. A plurality of cutting elements 13 are disposed on the roller cones 11. Nozzles 15 are disposed in the bit body 9 so as to transmit a flow of drilling fluid from an interior of the drill bit 8 to a wellbore (not shown) and to a space proximate the roller cones 11. The flow of drilling fluid serves to cool the drill bit 8 (e.g., to cool the plurality of cutting elements 13) and to transport formation cuttings from the bottom of the wellbore to a wellbore annulus (not shown) and, subsequently, to the surface.

Figure 2:
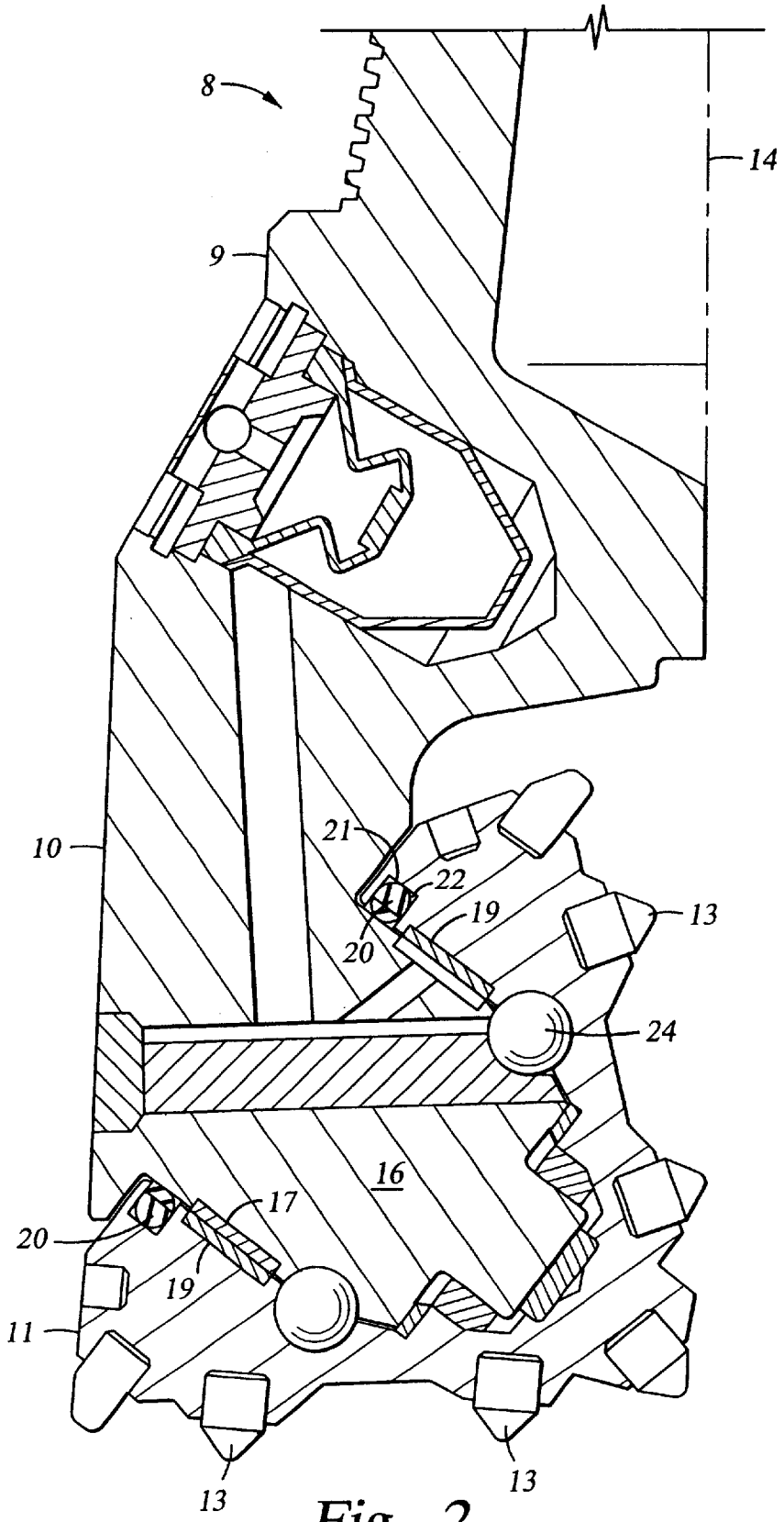
FIG. 2 shows a cross sectional view of the roller cone drill bit shown in FIG. 1.

FIG. 2 shows a cross sectional view of one leg 10 of the drill bit 8 shown in FIG. 1. The drill bit 8 further comprises a rotational axis 14 and three legs 10 (one of which is shown in FIG. 2) to which the roller cones 11 are rotatably attached. Each leg 10 includes a journal pin 16 that extends downwardly and radially inwardly. A plurality of radial bearings and axial thrust bearings are disposed between the journal pin 16 and the roller cone 11. The plurality of radial and thrust bearings absorb and transfer loads produced by the roller cones 11 contacting a formation (not shown) and drilling the wellbore. Effectively, loads are transferred from the roller cones 11 to the bit body 9 and, subsequently, to the BHA.

The plurality of radial and thrust bearings include, for example, radial bearing inserts 17, 19. These and other bearing surfaces are lubricated by, for example, high-temperature grease. Grease may be pumped into the interior of the journal pin 16/roller cone 11 interface through, for example, a grease fill passage. Details of the grease fill passage and system, as well as a typical grease system pressure compensation mechanism may be found, for example, in U.S. Pat. No. 6,170,830 issued to Cawthome et al. and assigned to the assignee of the present invention. The lubricating grease reduces the friction and, as a result, the operating temperature of the bearings in the drill bit 8. Reduced friction increases drill bit performance and longevity, among other desirable properties. The grease is retained in the load bearing regions of the drill bit 8 by, for example, a dual dynamic seal 20. The dual dynamic seal 20 is typically disposed in a seal groove 22 formed on an internal surface of the roller cone 11. However, the seal groove 22 may alternatively be formed on an external surface of the journal pin 16, and the placement of the seal groove 22 is not intended to be limiting. The dual dynamic seal 20 is typically compressed laterally by a selected amount in the seal groove 22. The compression, which is also referred to as "squeeze," is produced when the dual dynamic seal 20 is compressed between the surface of the journal pin 16 and an inner surface 21 of the seal groove 22. The selected amount of compression may be varied, for example, by controlling either a radial thickness of the dual dynamic seal 22 of by controlling the depth of the seal groove 22.

The dual dynamic seal 20 is adapted to retain lubricating grease proximate the bearings surfaces of the drill bit 8 and to serve as a barrier to prevent, for example, drilling fluid, hydrocarbons, and/or drilling debris from impinging upon the interior of the journal pin 16/roller cone 11 interface and thereby damaging the radial and thrust bearings. Because of the variety of chemicals, hydrocarbons, and operating conditions experienced when drilling the wellbore, the dual dynamic seal 20 must be geometrically designed and formed from selected materials to provide an effective barrier between the bearings surfaces and the wellbore environment.

Figure 3:
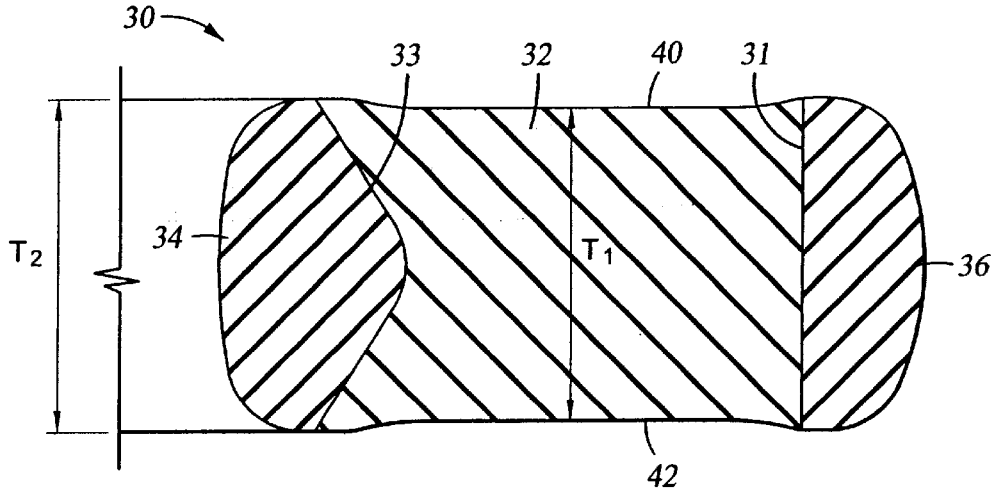
FIG. 3 shows a cross sectional view of an embodiment of the invention.

FIG. 3 shows an embodiment of a dual dynamic seal 30. Generally, the dual dynamic seal 30 comprises a seal body 32 that is formed in the shape of a substantially flat ring, and has generally differently configured seal surfaces on internal and external diameters thereof. The embodiment shown in FIG. 3 comprises an internal diameter (ID) dynamic seal surface 34 and an outer diameter (OD) dynamic seal surface 36. Moreover, the dual dynamic seal 30 comprises an asymmetric cross section (e.g., in the embodiment shown in FIG. 3, the ID and OD seal surfaces 34, 36 are not symmetric about a vertical line constructed perpendicular to upper and lower surfaces 40, 42 of the dual dynamic seal 30 proximate the lateral center of the seal body 32). However, the cross section of dual dynamic seals may be symmetric, and the asymmetric arrangement shown in FIG. 3 is not intended to be limiting. The dual dynamic seal 30 shown in FIG. 3 may be referred to as a high aspect-ratio seal because an axial thickness of the seal is less than a radial thickness of the seal.

The dual dynamic seal 30 is designed to withstand rotation relative to both the internal 34 and the external 36 surfaces thereof. Thus, the dual dynamic seal 30 may withstand "stick-slip" behavior. By contrast, the OD seal surface surfaces of prior art seal designs are typically arranged to form a static seal with an internal surface of a seal gland (where the seal gland is formed on an internal surface of a roller cone). During operation of a drill bit, for example, an increase in the operating temperature may cause a decrease in desirable properties of the seal elastomer, the ID seal surface may become static by sticking and the OD seal surface then would become dynamic. When rotation occurs at the OD seal surface, which is usually formed from a relatively soft elastomer and has a relatively poor wear resistance, the OD seal surface experiences severe wear and may fail after a short time.

In some embodiments, the ID seal surface 34 is intended to be dynamic while the OD seal surface 36 is intended to be static. However, the relationship may be reversed and a selection of either the ID seal surface 34 or the OD seal surface 36 as a "primary" dynamic seal is not intended to be limiting. Regardless of which seal is the primary dynamic seal, the dual dynamic seal 30 is adapted to withstand rotation at both the ID seal surface 34 and at the OD seal surface 36. The following example describes a situation where the ID seal surface 34 is designed to be the "primary" dynamic seal. The description is provided to clarify the function of the dual dynamic seal 30 and is not intended to be limiting.

The dual dynamic seal 30 shown in FIG. 3 is formed from at least three generally concentric elements. For example, the seal body 32 is positioned between the ID seal surface 34 and the OD seal surface 36. However, the dual dynamic seal 30 may be formed from more than three elements. For example, the ID seal surface 34 and/or the OD seal surface 36 may be formed from two or more dynamic seal elements (not shown) that are bonded (e.g., cross-linked) together. Accordingly, the number of seal elements used to form, for example, the ID seal surface 34, is not intended to be limiting.

Generally, the materials used to form the seal body 32 are selected to provide stability and flexibility over a wide range of operating temperatures. The seal body 32 forms an "energizer" for the ID seal surface 34 and the OD seal surface 36, and the seal body 32 typically has a lower stiffness than the dynamic seal surfaces 34, 36. Temperature stability and flexibility, among other factors, are important aspects of the seal body 32 because of the dynamic seal surfaces 34, 36 bonded to the internal and external diameters thereof.

The seal body 32 is generally not subjected to the same extreme operating conditions of operating temperature, relative motion, abrasive environment, etc., as the dynamic seal surfaces 34, 36. Accordingly, seal properties such as wear resistance, low coefficient of friction, high temperature stability, and the like are not as important for the seal body 32. The seal body 32 is, therefore, preferably formed from relatively softer (e.g., lower durometer rubber or elastomeric materials that are capable of at least some axial deflection). The softer material is also better able to act as an energizer so as to transfer forces to the dynamic seal surfaces 34, 36 and produce a sufficient amount of contact pressure between the dynamic seal surfaces 34, 36 and the adjacent journal pin (16 in FIG. 2) and/or inner surface (21 in FIG. 2) of the seal groove (22 in FIG. 2) or the roller cone (11 in FIG. 2).

Some embodiments of the seal body 32 comprise nitrile or highly saturated nitrile (HSN) elastomers that have a durometer Shore A hardness measurement in a range of from about 60 to 80, and preferably less than about 75. Other embodiments comprise a modulus of elasticity at 100 percent elongation of between about 2100 to 5000 kilopascals (kPa), elongation of from about 200 to 1000 percent, a minimum tensile strength of from about 11000 to 34000 kPa, and a compression set after 70 hours at 100 degrees C. in the range of from about 5 to 18 percent. Materials with these or similar properties form seal bodies that have a desired degree of deflection so as to provide enhanced sealing under extreme operating conditions, thereby extending the service life of the drill bit. Other embodiments of the seal body 32 are formed from an HSN elastomer that has a durometer Shore A hardness measurement in the range of from about 75 to 98, a modulus of elasticity at 100 percent elongation of between about 1500 to 4200 kPa, elongation of from about 150 to 500 percent, a minimum tensile strength of approximately 3000 kPa, and a compression set after 70 hours at 100 degrees C. of approximately 5 to 25 percent.

The seal body 32 shown in FIG. 3 also comprises a reduced seal body axial thickness T1 when compared to an axial thickness T2 proximate the dynamic seal surfaces 34, 36. The reduced seal body axial thickness T1 allows for axial expansion of the dual dynamic seal 30 when, for example, the seal is installed in the seal groove 22. For example, in one embodiment, the axial thickness T1 is selected so that when the dual dynamic seal 30 is compressed in the seal groove (22 in FIG. 2), the upper 40 and lower 42 surfaces of the dual dynamic seal 30 are substantially flat from ID to OD. In this embodiment, the installed dual dynamic seal 30 forms a substantially rectangular cross section.

The reduced seal body axial thickness T1 also allows for expansion due to, for example, thermal expansion, swelling and other factors. Accordingly, the dual dynamic seal 30 may expand within the seal groove (22 in FIG. 2) without becoming unstable by, for example, having expansion be limited by contact with either or both upper and lower surfaces of the seal groove 22 in FIG. 2). Note that the embodiment comprises a contoured upper surface 40 and a contoured lower surface 42 that form "recesses" in the dual dynamic seal 30. The recesses allow clearance between the upper and lower surfaces 40, 42 to permit expansion of the dual dynamic seal 30 due to installation, high temperatures, etc.

Figure 4:
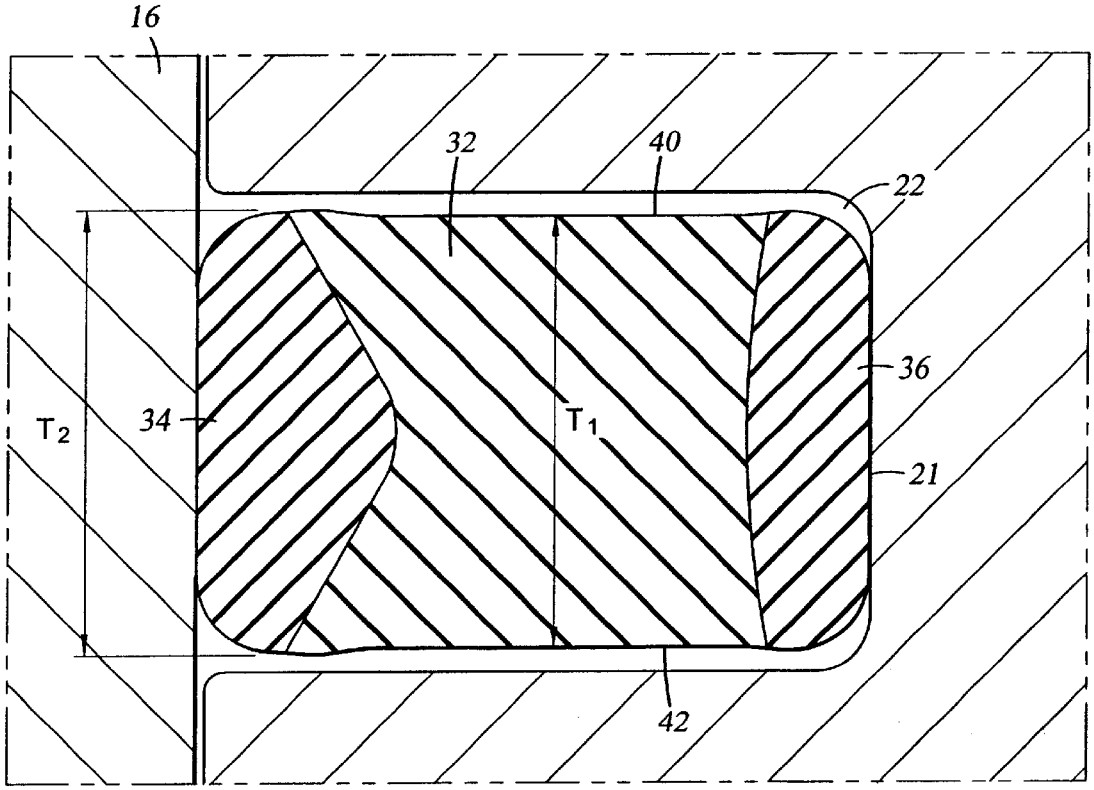
FIG. 4 shows a cross sectional view of an embodiment of the invention in an installed configuration.

An example of the dual dynamic seal 30 having a deformed profile after installation in the seal groove 22 is shown in FIG. 4. The ID seal surface 34 and the OD seal surface 36 are in contact with the journal pin 16 and the inner surface 21 of the seal groove 22, respectively. In the installed condition, the seal body axial thickness T1 has increased as the upper surface 40 and the lower surface 42 of the seal body 32 have expanded slightly to form substantially flat, continuous surfaces between the ID and the OD (compare with, for example, the uninstalled seal shown in FIG. 3). As shown in FIG. 4, when the dual dynamic seal is installed in the seal groove 22, the axial seal thickness T1 proximate the seal body 32 is approximately equal to the axial thickness T2 proximate the ID and OD seal surfaces 34, 36. Further, even when the upper 40 and lower surfaces 42 have expanded in the seal groove 22, the surfaces 40, 42 do not contact walls of the seal groove 22 and clearance remains to account for, for example, thermal expansion of the seal body 32 due to increased downhole operating temperatures and pressures.

Referring again to FIG. 3, the allowance for expansion of the dual dynamic seal 30 is advantageous because, for example, if expansion of the dual dynamic seal 30 were to cause the seal to contact both the upper and lower surfaces of the seal groove (22 in FIG. 2), further expansion of the dual dynamic seal 30 would be physically constrained to the radial direction. Radial expansion of the dual dynamic seal 30 could lead to, for example, an undesirable increase in contact pressure and friction between the dynamic seal surfaces 34, 36 and the journal pin (16 in FIG. 2) and the inner surface (21 in FIG. 2), respectively, and cause excessive wear, premature seal failure, etc.

The ID seal surface 34 and the OD seal surface 36 are typically formed from an elastomer that is designed to have an optimized hardness and modulus of elasticity to provide, for example, maximum wear resistance, thermal stability, and the like. Moreover, the dynamic seal surfaces 34, 36 are adapted to form dynamic wear resistant surfaces that comprise both self-lubricating properties and stability over a wide ranger of operating temperatures. Alternatively, the ID seal surface 34 and the OD seal surface 36 may be formed from different materials.

The dynamic seal surfaces 34, 36 are generally subjected to high temperatures and a highly abrasive environment. During drilling operations, the dynamic seal surfaces 34, 36 may be exposed to temperatures in the range of from about 100 to 250 degrees C, pressures of approximately 140000 kPa or greater, and rotational speeds varying from about 60 to about 400 rpm. Suitable materials for forming the ID seal surface 34 and the OD seal surface 36 include rubber and elastomeric materials selected from the group comprising carboxylated nitrites, highly-saturated nitrites (HSN), nitrile-butadiene rubbers (HBR), highly saturated nitrile-butadiene rubbers (HNBR), and the like. Some embodiments include materials that have a modulus of elasticity at 100 percent elongation of greater than about 4500 kPa, and that have a standard compression set after 70 hours at 100 degrees C. of less than about 20 percent.

Other embodiments of the dynamic seal surfaces 34, 36 include those having materials with a durometer Shore A hardness measurement in the range of from about 75 to 95, and more preferably greater than about 85. Some embodiments include materials that have a modulus of elasticity at 100 percent elongation of in the range of from about 1000 to 2000 psi, elongation of from about 100 to 400 percent, a tensile strength of in the range of from about 3000 and 6000 psi, and a compression set after 70 hours at 100 degrees C. in the range of from about 8 to 25 percent. Materials having these properties typically provide a desired degree of wear resistance, abrasion resistance, friction resistance, and temperature stability to enhance seal performance (by the ID seal surface 34 and the OD seal surface 36) under difficult operating conditions, thereby extending the service life of the drill bit.

Note that, in some embodiments, relatively "harder" rubber or elastomeric materials are preferred to form the dynamic seal surfaces 34, 36 because the harder materials are more stable at higher temperatures. Harder materials help reduce friction torque and minimize stick-slip, thereby resulting in less adhesive wear and less heat generation.

Other suitable materials that may be used to form the ID seal surface 34 and/or the OD seal surface 36 include self-lubricating rubber or elastomeric compounds that include one or more lubricant additive(s) to provide enhanced properties of wear and friction resistance. Desirable self-lubricating compounds generally have similar physical properties as those described above. In some embodiments, a self-lubricating compound includes HNBR comprising one or more lubricant additives selected from the group of dry lubricants comprising polytetrafluoroethylene (PTFE), graphite flake, hexagonal boron nitride (hBN), molybdenum disulfide, and other known fluoropolymeric, dry, or polymeric lubricants and mixtures thereof. It has been determined, for example, that hBN or graphite flake can be used as a partial substitute for carbon black to provide strength to the elastomeric material, to reduce the coefficient of friction of the elastomeric material, and to reduce the amount of abrasive wear that is caused by the elastomeric material (e.g., to make the elastomeric material less abrasive). In an exemplary embodiment, HNBR used to form the dynamic seals 34, 36 comprises in the range of from about 5 to 20 percent by volume graphite flake or hBN.

Further, while the dynamic seal surfaces 34, 36 may be formed from elastomeric materials, they may also be formed from alternative materials such as, for example, non-elastomeric materials, metallic materials, non-metallic materials, and combinations thereof. In some embodiments, the dynamic seal surfaces 34, 36 are formed from composite materials having both elastomeric and nonelastomeric components that are adapted to provide improved properties over using elastomeric and non-elastomeric materials alone. An example of such a composite material comprises a non-elastomeric component in the form of fibers such as polyester fiber, cotton fiber, aromatic polyamides such as those sold under the trade name Kevlar by E. I. DuPont de Nemours and Co. of Wilmington, Del., polybenzimidazole (PBI) fiber, poly m-phenylene isophthalamide fiber such as those sold under the trade name Nomex by E. I. DuPont de Nemours and Co. of Wilmington, Del., and mixtures and blends thereof. The fibers can either be used in their independent state and combined with an elastomeric composite component, or may be combined into threads or woven into fabrics with an elastomeric composite component. On example of a class of composites formed from a non-elastomeric polymeric material and an elastomeric material includes those having a softening point higher than about 350 degrees .F and having a tensile strength of greater than about 10 Kpsi.

Other composite materials suitable for forming composite seals include those that display properties of high-temperature stability and endurance, wear-resistance, and have a coefficient of friction similar to that of the polymeric materials described above. Further, glass fiber may be used to strengthen the polymeric material and, for example, form a core for the polymeric material.

FIG. 3 also shows that some embodiments of the invention comprise non-planar interfaces between, for example, the ID seal surface 34 and the seal body 32. The embodiment shown in FIG. 3 shows a planar interface 31 between the OD seal surface 36 and the seal body 32 and a substantially V-shaped, non-planar interface 33 between the ID seal surface 34 and the seal body 32. However, non-planar interfaces may be used, for example, between the OD seal surface 36 and the seal body 32 as well. Moreover, the non-planar interface 33 may be V-shaped, elliptical, parabolic, arcuate, or any other suitable geometry known in the art. The non-planar interface 33 may also comprise, for example, a plurality of V-shaped interfaces to form a "zig-zag" pattern.

While planar interfaces may be used with the invention, non-planar interfaces increase an area of contact between the dynamic seal surfaces 34, 36 and the seal body 32. The increased area of contact improves a stress distribution between materials and may increase the longevity and wear resistance of the dual dynamic seal 30. Moreover, the increased area of contact helps improve bonding between, for example, the dynamic seal surfaces 34, 36 and the seal body 32 by providing a greater cross section through which cross-linking may occur.

Additionally, non-planar interfaces may be used to produce a desired contact stress pattern between the dynamic seal surfaces 34, 36 and their associated contact surfaces (e.g., the journal pin (16 in FIG. 2) and the inner surface (21 in FIG. 2) of the seal groove (22 in FIG. 2)). Optimizing the contact stress profile can reduce wear, reduce heat generation, and help control the overall sealing force, thereby improving the reliability and longevity of the seal under tough operating conditions.

Figure 5:
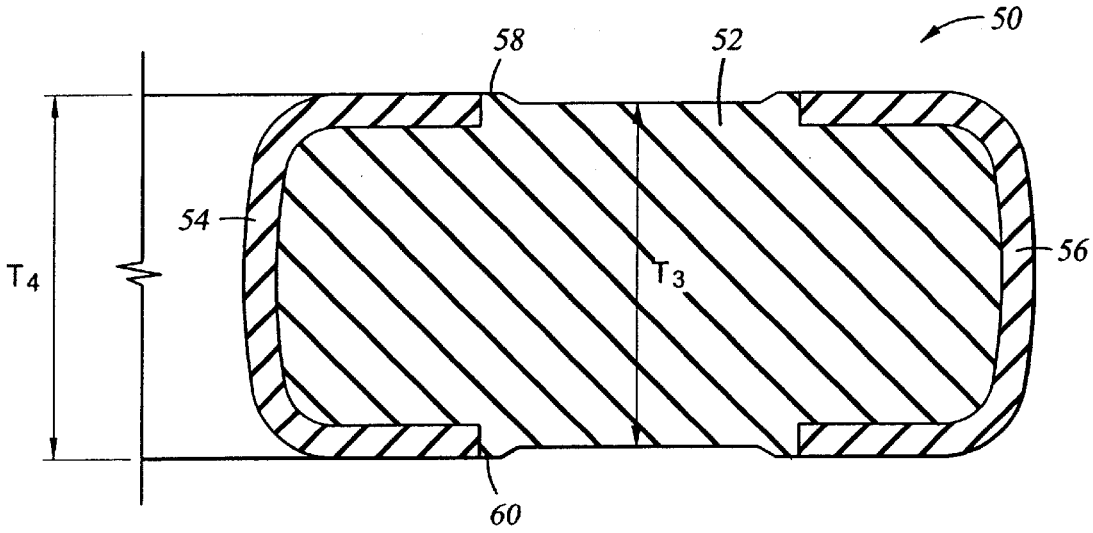
FIG. 5 shows a cross sectional view of an embodiment of the invention.

Another embodiment of the invention is shown in FIG. 5. A dual dynamic seal 50 comprises a seal body 52, an ID dynamic seal surface 54, and an OD dynamic seal surface 56. The dual dynamic seal 50 is similar to those described above in that it has a reduced axial thickness T3 proximate the lateral center of the seal body 52 and an increased axial thickness T4 proximate the dynamic seal surfaces 54, 56. Further, in this embodiment, the ID seal surface 54 and the OD seal surface 56 comprise composite fabric seals as described above. The dynamic seal surfaces 54, 56 enclose radial ends of the seal body 52 and wrap around to at least partially cover a contoured upper surface 58 and a contoured lower surface 60.

Figure 6:
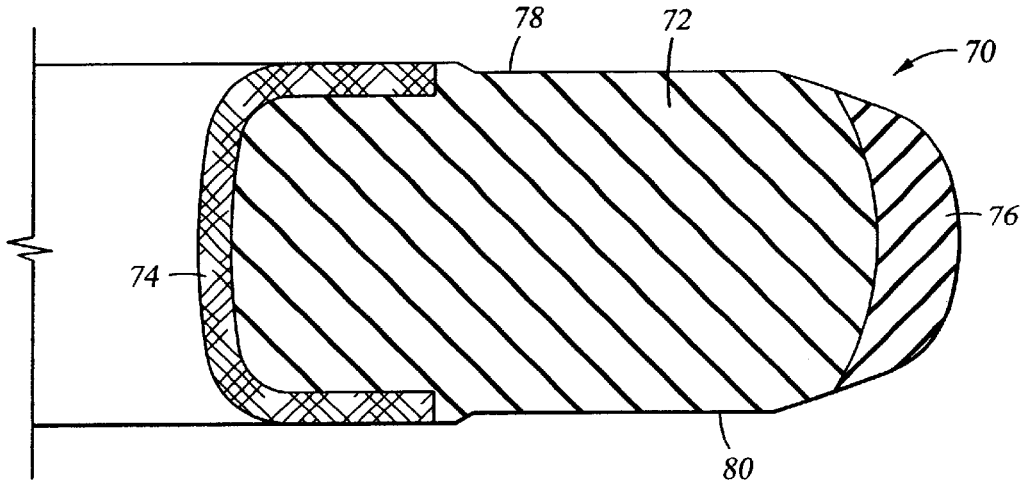
FIG. 6 shows a cross sectional view of an embodiment of the invention.

Another embodiment of the invention is shown in FIG. 6. A dual dynamic seal 70 comprises a seal body 72, an ID dynamic seal surface 74, and an OD dynamic seal surface 76. In this embodiment, the OD seal surface 76 is asymmetric with respect to the ID dynamic seal surface 74. The dynamic seal surfaces 74, 76 may be formed from either similar or dissimilar materials. For example, the ID seal surface 74 may comprise a composite fabric seal while the OD seal surface 76 may comprise a substantially elastomeric seal. However, other combinations are possible and the examples described above are not intended to be limiting. Note that the embodiment shown in FIG. 6 also comprises contoured upper 78 and lower 80 surfaces that are adapted to provide clearance between the surfaces 78, 80 and a seal groove (not shown) when the dual dynamic seal 70 expands because of compression, thermal expansion, etc.

The embodiments shown in FIGS. 4–6 may comprise a variety of geometries. For example, the embodiments may include a variety of curvatures for both the ID dynamic seals and the OD dynamic seals. Moreover, aspect ratios (wherein the aspect ratio is generally defined as a radial thickness of a seal divided by an axial thickness of the seal) of the dual dynamic seals may be modified to best suit specific operating conditions and/or specific drill bit geometries. For example, some of the embodiments of the invention comprise aspect ratios of greater than 1, while other embodiments comprise aspect ratios of at least 1.5. Accordingly, the embodiments shown in FIGS. 4–6 are intended to show examples of dual dynamic seals formed within the scope of the invention and are not intended to be limiting with respect to, for example, seal curvatures, seal diameters, seal aspect ratios, etc.

The foregoing embodiments of a seal according to the invention are all so-called "lateral-" or "radial-" type seal. Radial-type seals are energized when compressed in a lateral or radial direction (generally between outer and inner diameters). The dynamic sealing surfaces on radial seals are generally disposed on the inner diametric surface and the outer diametric surface of the seal. In the foregoing embodiments, the inner and outer diametric seal surfaces include thereon a material adapted to withstand relative motion between the journal pin and roller cone, and the corresponding dynamic sealing surface on the seal. In the various embodiments of the radial seal according to the invention which include recessed axial surfaces (when the seal is uncompressed laterally), such recessed axial surfaces are disposed generally on either or both the upper and lower axial surfaces of the seal.

Figure 7:
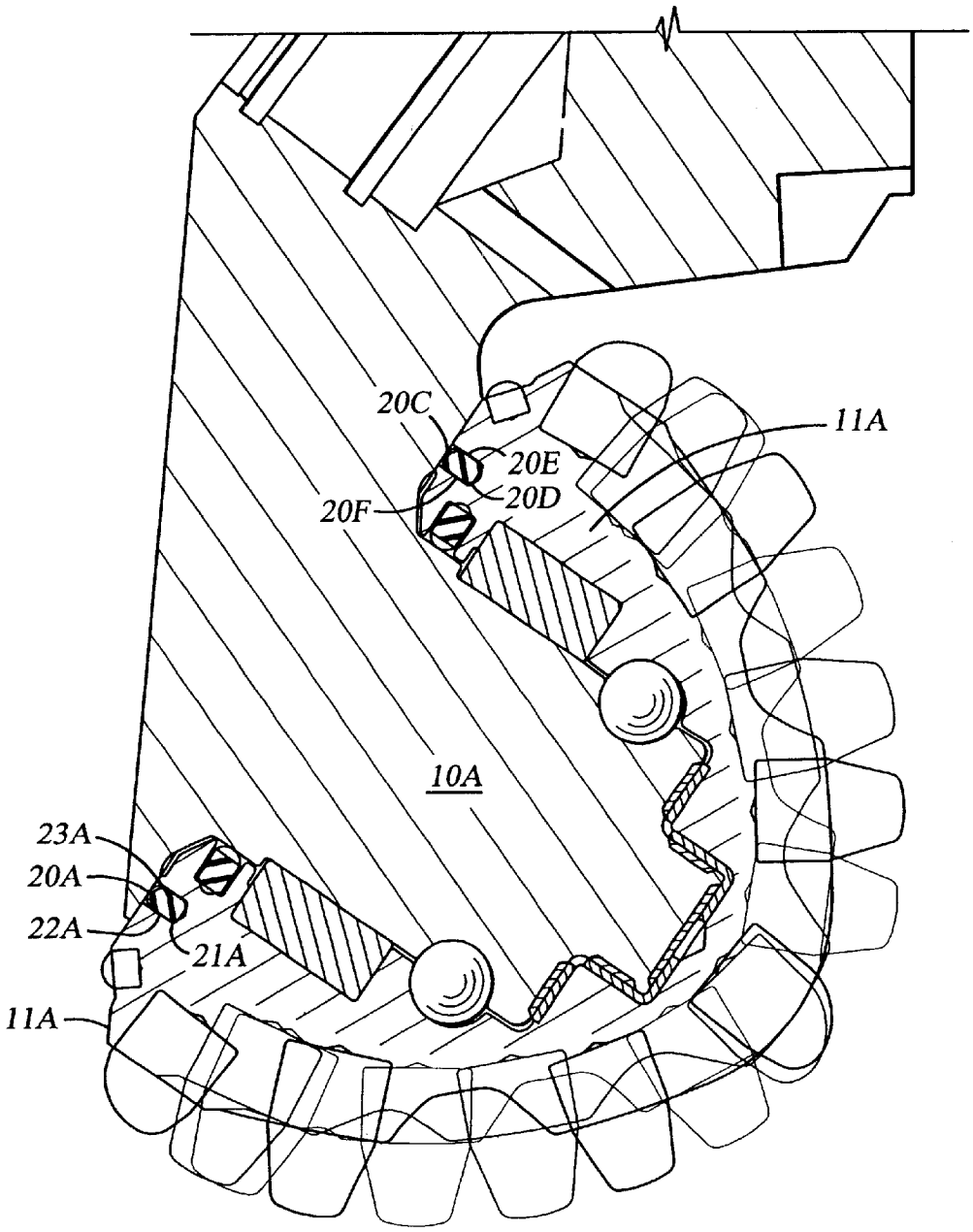
FIG. 7 shows an alternative orientation of a seal according to various embodiments of the invention.

It should be clearly understood, however, that the invention is not limited in scope to lateral- or radial-type seals. The invention can also be used in various embodiments of an axial-type seal. An example of an axial-type seal as used in a roller cone drill bit is shown in FIG. 7. A dual dynamic axial seal 20A is shown disposed in a groove 22A therefor formed in the roller cone 11A. As in the other embodiments of the invention, the seal groove may alternatively or additionally (for multiple seal applications) be formed in the journal pin 10A. The seal 20A in FIG. 7 is referred to as an axial-type seal because it is energized by compression of the seal body 23A along its longitudinal axis, roughly between the upper and lower axial surfaces 20C, 20D, so that the axial surfaces 20C, 20D sealingly engage the corresponding seal surface 21A in the cone 11A, and the opposed sealing surface on the journal pin 110A. In various axial seal embodiments, the axial surfaces 20C, 20D include thereon a material similar or identical in nature to the materials described for the foregoing radial seal embodiments, this material being adapted to withstand moving contact between the cone and journal pin and the mating seal surfaces. Lateral surfaces 20E, 20F in axial seals may be formed having a depression or recess therein when the seal 20A is axially uncompressed, such that when the seal is axially compressed, the lateral surfaces 20E, 20F are substantially planar, and/or provide clearance between the lateral surfaces 20E, 20F and the walls of the groove 22A. This is substantially the same concept as for the radial seal shown in FIGS. 3 and 4.

All of the foregoing description relating to radial seals is likewise applicable to axial seals with respect to the dynamic sealing surfaces, the contact stress profiles and selected materials. The difference between axial and radial seal embodiments is merely that the orientation of all the elements of an axial seal, according to the various embodiments of the invention, are rotated about 90 degrees with respect to the seal dimensions as compared to the radial seal embodiments described herein previously.

It should also be noted that the invention is not limited only to axial or radial seals, wherein the sealing surfaces are on opposite sides of the seal body. Other types of seals, referred to as "canted seals", include sealing surfaces on the roller cone and on the journal pin which are opposed to each other across the seal body along a line which is neither parallel to the bearing axis (as is the case for axial seals) nor perpendicular to the bearing axis (as is the case for lateral seals). In various embodiments of canted seals, first and second dynamic sealing surfaces on the seal may include a material adapted to withstand relative rotation between the roller cone and the journal pin, as in the other embodiments of the invention. The only difference is that in canted seals, the dynamic sealing surfaces on opposite sides of the seal body are compressed along a line which includes both axial and radial components. Other aspects of the various embodiments of the invention, including the various shapes of the boundary between the seal body and the dynamic sealing surface materials to provide a selected contact stress profile, and the various external sealing surface shapes of the dynamic sealing surfaces, are equally applicable to various embodiments of a canted seal according to the invention.

Figure 8:
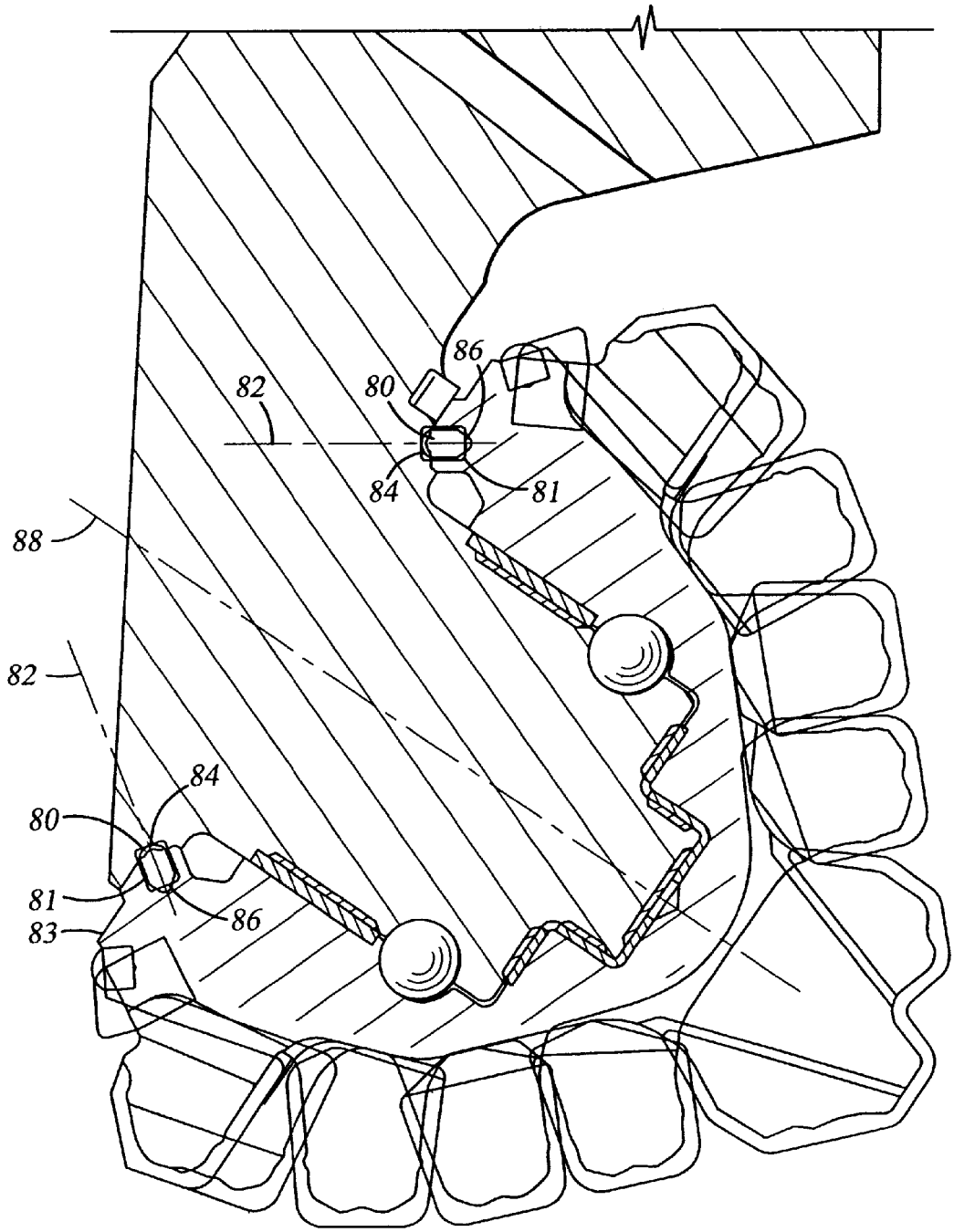
FIG. 8 shows an example of a canted seal according to various aspects of the invention.

An example of a canted seal is shown in FIG. 8. The canted seal 80 is shown disposed in a seal groove 811*n* the roller cone 83. As in other embodiments, the seal groove may alternatively be disposed in the bit body in the journal area. The seal 80 includes first 84 and second 86 dynamic sealing surfaces which are compressed along a line 82 which is neither parallel to the bearing axis 88 nor perpendicular to the bearing axis 88. Thus, compression of the canted seal 80 includes both axial and radial components.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit comprising a seal adapted to seal between a bit body and a roller cone rotatably mounted on the bit body, the seal comprising:

a seal body formed from a material adapted to energize the seal after compression thereof;

a first dynamic seal surface formed on the seal body and adapted to seal against the bit body; and a second dynamic seal surface formed on the seal body and adapted to seal against the roller cone, the first and second dynamic seal surfaces each formed from a material adapted to withstand relative motion between the first dynamic seal surface and the bit body and between the second dynamic seal surface and the roller cone.

2. The roller cone drill of claim 1, wherein the seal is disposed in a groove formed in the roller cone.

3. The roller cone drill bit of claim 1, wherein the seal is disposed in a groove formed in the bit body.

4. The roller cone drill bit of claim 1, wherein the seal body comprises recessed surfaces substantially perpendicular to the first and second dynamic sealing surfaces, the recessed surfaces adapted to allow expansion of the seal while maintaining clearance between the seal and a seal groove when the seal is compressed so as to energize the first and second dynamic seal surfaces.

5. The roller cone drill bit of claim 1, wherein an axial thickness of the seal proximate the seal body is approximately equal to an axial thickness of the seal proximate the first dynamic seal surface when the seal is laterally compressed so as to energize the first and second dynamic seal surfaces.

6. The roller cone drill bit of claim 1, wherein an interface between the first dynamic seal surface and the seal body is substantially planar.

7. The roller cone drill bit of claim 1, wherein an interface between the first dynamic seal surface and the seal body is non-planar.

8. The roller cone drill bit of claim 1, wherein an interface between the first dynamic seal surface and the seal body is generally "V" shaped.

9. The roller cone drill bit of claim 1, wherein an interface between the second dynamic seal surface and the seal body is substantially planar.

10. The roller cone drill bit of claim 1, wherein an interface between the second dynamic seal surface and the seal body is non-planar.

11. The roller cone drill bit of claim 1, wherein an interface between the second dynamic seal surface and the seal body is generally "V" shaped.

12. The roller cone drill bit of claim 1, wherein an interface between the first dynamic seal surface and the seal body is adapted to form a selected contact stress profile between the first dynamic seal surface and the bit body.

13. The roller cone drill bit of claim 1, wherein an interface between the second dynamic seal surface and the seal body is adapted to form a selected contact stress profile between the second dynamic seal surface and the roller cone.

14. The roller cone drill bit of claim 1, wherein an interface between the first dynamic seal surface and the seal body is adapted to form a selected cross sectional area for bonding the first dynamic seal surface to the seal body.

15. The roller cone drill bit of claim 1, wherein an interface between the second dynamic seal surface and the seal body is adapted to form a selected cross sectional area for bonding the second dynamic seal surface to the seal body.

16. The roller cone drill bit of claim 1, wherein a part of the first dynamic seal surface that seals against the bit body is substantially planar.

17. The roller cone drill bit of claim 1, wherein at least part of the first dynamic seal surface that seals against the bit body is non-planar.

18. The roller cone drill bit of claim 1, wherein a part of the second dynamic seal surface that seals against the roller cone is substantially planar.

19. The roller cone drill bit of claim 1, wherein at least part of the second dynamic seal surface that seals against the roller cone is non-planar.

20. The roller cone drill bit of claim 1, wherein the seal body is formed from an elastomeric material.

21. The roller cone drill bit of claim 20, wherein the elastomeric material comprises at least one of nitrile, carboxylated nitrile, and highly saturated nitrile elastomers.

22. The roller cone drill bit of claim 1, wherein the first dynamic seal surface is formed from an elastomeric material.

23. The roller cone drill bit of claim 22, wherein the elastomeric material comprises at least one of nitrile, carboxylated nitrile, highly saturated nitrile, nitrile-butadiene, and highly saturated nitrile-butadiene elastomers.

24. The roller cone drill bit of claim 22, wherein the elastomeric material comprises a self-lubricating elastomer.

25. The roller cone drill bit of claim 1, wherein the first dynamic seal surface is formed from a non-elastomeric material.

26. The roller cone drill bit of claim 25, wherein the non-elastomeric material comprises a fiber.

27. The roller cone drill bit of claim 25, wherein the non-elastomeric material comprises a fabric.

28. The roller cone drill bit of claim 1, wherein the second dynamic seal surface is formed from an elastomeric material.

29. The roller cone drill bit of claim 28, wherein the elastomeric material comprises at least one of nitrile, carboxylated nitrile, highly saturated nitrile, nitrile-butadiene, and highly saturated nitrile-butadiene elastomers.

30. The roller cone drill bit of claim 28, wherein the elastomeric material comprises a self-lubricating elastomer.

31. The roller cone drill bit of claim 1, wherein the second dynamic seal surface is formed from a non-elastomeric material.

32. The roller cone drill bit of claim 31, wherein the non-elastomeric material comprises a fiber.

33. The roller cone drill bit of claim 31, wherein the non-elastomeric material comprises a fabric.

34. A roller cone drill bit comprising a seal adapted to seal between a first sealing surface disposed on a bit body of the drill bit and a second sealing surface disposed on a roller cone rotatably mounted on the bit body, the seal comprising:

a seal body formed from a material adapted to energize the seal after lateral compression thereof;

a first dynamic seal surface formed on an inner diameter of the seal body; and a second dynamic seal surface formed on an external diameter of the seal body, wherein the first dynamic seal surface is adapted to seal against the first sealing surface and the second dynamic seal surface is adapted to seal against the second sealing surface, the first and second dynamic seal surfaces each formed from a material adapted to withstand relative motion between the first dynamic seal surface and the first sealing surface and between the second dynamic seal surface and the second sealing surface.

35. A roller cone drill bit comprising a seal adapted to seal between a bit body and a roller cone rotatably mounted on the bit body, the seal comprising:

a seal body formed from a material adapted to energize the seal after lateral compression thereof, the seal body comprising a recessed upper axial surface and a recessed lower axial surface, at least one of the recessed upper and lower axial surfaces adapted to axially expand in a selected manner after lateral compression of the seal;

a first dynamic seal surface formed on an inner diameter of the seal body and adapted to seal against the bit body; and a second dynamic seal surface formed on an external diameter of the seal body and adapted to seal against the roller cone, the first and second dynamic seal surfaces each formed from a material adapted to withstand relative motion between the first dynamic seal surface and the bit body and between the second dynamic seal surface and the roller cone.

36. The roller cone drill bit of claim 35, wherein the upper and lower axial surfaces are formed in an uncompressed state to be substantially planar after the seal has been laterally compressed.

37. The roller cone drill bit of claim 35, wherein the upper and lower axial surfaces are shaped to form an axial thickness along the seal body that is approximately equal to an axial thickness of the seal proximate the first and second dynamic seal surfaces after the seal has been laterally compressed.

38. The roller cone drill bit of claim 35, wherein an interface between the first dynamic seal surface and the seal body is substantially planar.

39. The roller cone drill bit of claim 35, wherein an interface between the first dynamic seal surface and the seal body is non-planar.

40. The roller cone drill bit of claim 35, wherein an interface between the second dynamic seal surface and the seal body is substantially planar.

41. The roller cone drill bit of claim 35, wherein an interface between the second dynamic seal surface and the seal body is non-planar.

42. The roller cone drill bit of claim 35, wherein an interface between the first dynamic seal surface and the seal body is adapted to form a selected contact stress profile between the first dynamic seal surface and the bit body.

43. The roller cone drill bit of claim 35, wherein an interface between the second dynamic seal surface and the seal body is adapted to form a selected contact stress profile between the second dynamic seal surface and the roller cone.

44. The roller cone drill bit of claim 35, wherein an interface between the first dynamic seal surface and the seal body is adapted to form a selected cross sectional area for bonding the first dynamic seal surface to the seal body.

45. The roller cone drill bit of claim 35, wherein an interface between the second dynamic seal surface and the seal body is adapted to form a selected cross sectional area for bonding the second dynamic seal surface to the seal body.

46. The roller cone drill bit of claim 35, wherein the seal body is formed from an elastomeric material.

47. The roller cone drill bit of claim 46, wherein the elastomeric material comprises at least one of nitrile, carboxylated nitrile, and highly saturated nitrile elastomers.

48. The roller cone drill bit of claim 35, wherein the first dynamic seal surface is formed from an elastomeric material.

49. The roller cone drill bit of claim 48, wherein the elastomeric material comprises at least one of nitrile, carboxylated nitrile, highly saturated nitrile, nitrile-butadiene, and highly saturated nitrile-butadiene elastomers.

50. The roller cone drill bit of claim 48, wherein the elastomeric material comprises a self-lubricating elastomer.

51. The roller cone drill bit of claim 35, wherein the first dynamic seal surface is formed from a non-elastomeric material.

52. The roller cone drill bit of claim 51, wherein the non-elastomeric material comprises a fiber.

53. The roller cone drill bit of claim 51, wherein the non-elastomeric material comprises a fabric.

54. The roller cone drill bit of claim 35, wherein the second dynamic seal surface is formed from an elastomeric material.

55. The roller cone drill bit of claim 54, wherein the elastomeric material comprises at least one of nitrile, carboxylated nitrile, highly saturated nitrile, nitrile-butadiene, and highly saturated nitrile-butadiene elastomers.

56. The roller cone drill bit of claim 54, wherein the elastomeric material comprises a self-lubricating elastomer.

57. The roller cone drill bit of claim 35, wherein the second dynamic seal surface is formed from a non-elastomeric material.

58. The roller cone drill bit of claim 57, wherein the non-elastomeric material comprises a fiber.

59. The roller cone drill bit of claim 57, wherein the non-elastomeric material comprises a fabric.

60. A drill bit, comprising:

a bit body;

at least one roller cone rotatably attached to the bit body; and a seal disposed between a first sealing surface located on the bit body and a second sealing surface located on the at least one roller cone, the seal comprising:

a seal body formed from a material adapted to energize the seal after lateral compression thereof, a first dynamic seal surface formed on an inner diameter of the seal body and adapted to seal against the first sealing surface, and a second dynamic seal surface formed on an external diameter of the seal body and adapted to seal against the second sealing surface, the first and second dynamic seal surfaces each formed from a material adapted to withstand relative motion between the first dynamic seal surface and the first sealing surface and between the second dynamic seal surface and the second sealing surface.

61. A roller cone drill bit comprising a seal adapted to seal between a bit body and a roller cone rotatably mounted on the bit body, the seal comprising:

a seal body formed from a material adapted to energize the seal after axial compression thereof;

a first dynamic seal surface formed on a first axial surface of the seal body and adapted to seal against the bit body; and a second dynamic seal surface formed on a second axial surface of the seal body and adapted to seal against the roller cone, the first and second dynamic seal surfaces each formed from a material adapted to withstand relative motion between the first dynamic seal surface and the bit body and between the second dynamic seal surface and the roller cone.

62. The roller cone drill bit of claim 61, wherein the seal is disposed in a groove formed in the roller cone.

63. The roller cone drill bit of claim 61, wherein the seal is disposed in a groove formed in the bit body.

64. The roller cone drill bit of claim 61, wherein the seal body comprises recessed inner and outer lateral surfaces adapted to allow lateral expansion of the seal while maintaining clearance between the seal and a seal groove when the seal is axially compressed so as to energize the first and second dynamic seal surfaces.

65. The roller cone drill bit of claim 61, wherein a lateral thickness of the seal proximate the seal body is approximately equal to a lateral thickness of the seal proximate the first dynamic seal surface when the seal is axially compressed so as to energize the first and second dynamic seal surfaces.

66. The roller cone drill bit of claim 61, wherein an interface between the first dynamic seal surface and the seal body is substantially planar.

67. The roller cone drill bit of claim 61, wherein an interface between the first dynamic seal surface and the seal body is non-planar.

68. The roller cone drill bit of claim 61, wherein an interface between the first dynamic seal surface and the seal body is generally "V" shaped.

69. The roller cone drill bit of claim 61, wherein an interface between the second dynamic seal surface and the seal body is substantially planar.

70. The roller cone drill bit of claim 61, wherein an interface between the second dynamic seal surface and the seal body is non-planar.

71. The roller cone drill bit of claim 61, wherein an interface between the second dynamic seal surface and the seal body is generally "V" shaped.

72. The roller cone drill bit of claim 61, wherein an interface between the first dynamic seal surface and the seal body is adapted to form a selected contact stress profile between the first dynamic seal surface and the bit body.

73. The roller cone drill bit of claim 61, wherein an interface between the second dynamic seal surface and the seal body is adapted to form a selected contact stress profile between the second dynamic seal surface and the roller cone.

74. The roller cone drill bit of claim 61, wherein an interface between the first dynamic seal surface and the seal body is adapted to form a selected cross sectional area for bonding the first dynamic seal surface to the seal body.

75. The roller cone drill bit of claim 61, wherein an interface between the second dynamic seal surface and the seal body is adapted to form a selected cross sectional area for bonding the second dynamic seal surface to the seal body.

76. The roller cone drill bit of claim 61, wherein a part of the first dynamic seal surface that seals against the bit body is substantially planar.

77. The roller cone drill bit of claim 61, wherein at least part of the first dynamic seal surface that seals against the bit body is non-planar.

78. The roller cone drill bit of claim 61, wherein a part of the second dynamic seal surface that seals against the roller cone is substantially planar.

79. The roller cone drill bit of claim 61, wherein at least part of the second dynamic seal surface that seals against the roller cone is non-planar.

80. The roller cone drill bit of claim 61, wherein the seal body is formed from an elastomeric material.

81. The roller cone drill bit of claim 80, wherein the elastomeric material comprises at least one of nitrile, carboxylated nitrile, and highly saturated nitrile elastomers.

82. The roller cone drill bit of claim 61, wherein the first dynamic seal surface is formed from an elastomeric material.

83. The roller cone drill bit of claim 82, wherein the elastomeric material comprises at least one of nitrile, carboxylated nitrile, highly saturated nitrile, nitrile-butadiene, and highly saturated nitrile-butadiene elastomers.

84. The roller cone drill bit of claim 82, wherein the elastomeric material comprises a self-lubricating elastomer.

85. The roller cone drill bit of claim 61, wherein the first dynamic seal surface is formed from a non-elastomeric material.

86. The roller cone drill bit of claim 85, wherein the non-elastomeric material comprises a fiber.

87. The roller cone drill bit of claim 85, wherein the non-elastomeric material comprises a fabric.

88. The roller cone drill bit of claim 61, wherein the second dynamic seal surface is formed from an elastomeric material.

89. The roller cone drill bit of claim 88, wherein the elastomeric material comprises at least one of nitrile, carboxylated nitrile, highly saturated nitrile, nitrile-butadiene, and highly saturated nitrile-butadiene elastomers.

90. The roller cone drill bit of claim 88, wherein the elastomeric material comprises a self-lubricating elastomer.

91. The roller cone drill bit of claim 61, wherein the second dynamic seal surface is formed from a non-elastomeric material.

92. The roller cone drill bit of claim 91, wherein the non-elastomeric material comprises a fiber.

93. The roller cone drill bit of claim 91, wherein the non-elastomeric material comprises a fabric.

94. The roller cone drill bit of claim 1 wherein the first and second dynamic sealing surfaces are disposed substantially on opposite sides of the seal body from each other, the seal further comprising outer surfaces substantially perpendicularly disposed to the first and second dynamic seal surfaces, the outer surfaces shaped when the seal is in an uncompressed state so as to maintain clearance between the outer surfaces and a seal groove when the seal is compressed between the first and second dynamic sealing surfaces.

* * * * *